US006248023B1

(12) United States Patent
Fish

(10) Patent No.: US 6,248,023 B1
(45) **Date of Patent: *Jun. 19, 2001**

(54) PHYSICAL ACTIVITY TRAINING DEVICE AND METHOD

(76) Inventor: Leonard Fish, P.O. Box 7891, Newport Beach, CA (US) 92658

( * ) Notice: Subject to any disclaimer, the term of this patent is extended or adjusted under 35 U.S.C. 154(b) by 0 days.

This patent is subject to a terminal disclaimer.

(21) Appl. No.: 09/254,359

(22) PCT Filed: Sep. 6, 1996

(86) PCT No.: PCT/US96/14264

§ 371 Date: Mar. 4, 1999

§ 102(e) Date: Mar. 4, 1999

(87) PCT Pub. No.: WO98/09689

PCT Pub. Date: Mar. 12, 1998

Related U.S. Application Data

(63) Continuation-in-part of application No. 08/163,367, filed on Dec. 6, 1993, now Pat. No. 5,553,857.

(51) Int. Cl.[7] ..... A63B 57/00
(52) U.S. Cl. ..... 473/209; 434/252
(58) Field of Search ..... 473/209, 207, 473/208, 211, 212, 213, 214; 434/252

(56) References Cited

U.S. PATENT DOCUMENTS 5,511,789 * 4/1996 Nakamura ..... 473/209
5,524,894 * 6/1996 Shannon ..... 473/209
5,553,857 * 9/1996 Fish ..... 473/209
5,558,585 * 9/1996 Nolan, Jr. ..... 473/211
5,632,688 * 5/1997 Blaakman ..... 473/209

* cited by examiner

*Primary Examiner*—Jessica J. Harrison
(74) *Attorney, Agent, or Firm*—John J. Connors; Connors & Associates

(57) ABSTRACT

A training device (FIGS. 1 and 2) for a person performing a physical activity wherein the proper performance thereof is related to the proper movement by the person (10). The device comprises a movement sensor (40), a trigger event sensor (50) for sensing the occurrence of a specific physical trigger event, a processor (60), an electronic memory (70), and a protective enclosure (95). The movement sensor (40) provides movement signal values to the processor (60), which is able to store these movement signal values in the memory (70). The trigger event sensor (50) provides trigger event signal values to the processor (60), such trigger event signal values corresponding to the occurrence of the specific physical trigger event near the device (FIGS. 1 and 2). The processor (60) is able to store the trigger event signal values in the memory (70), and evaluate the trigger event signal values (FIGS. 4A–4D, and 90) to determine if the specific trigger event has occurred.

20 Claims, 4 Drawing Sheets

PHYSICAL ACTIVITY TRAINING DEVICE AND METHOD

RELATED PATENT APPLICATION

This application is a continuation-in-part application of U.S. Ser. No. 163,367, entitled "Physical Activity Training Device And Method," filed Dec. 6, 1993, now U.S. Pat. No. 5,553,857.

FIELD OF THE INVENTION

This invention relates generally to a training device. More particularly, this invention is directed towards an electronic device for training a person to correctly perform a physical activity.

BACKGROUND OF THE INVENTION

In many physical activities, such as golf, baseball, tennis, and the like, correct execution of the activity requires precise movement of at least one movable member, such as the head of the golfer, the arms of the batter, and the tennis racquet of the tennis player. For example, a golfer who lifts its head too early while swinging a golf club will often hit a golf ball incorrectly. Typically, however, the subsequent flight of the golf ball does not provide enough feedback to the golfer as to tile correctness of his execution of the swing of the golf club. Consequently, the golfer cannot learn from his mistakes as quickly as if he were given immediate feedback as to tile cause of the errant shot, namely, His lifting his head too early.

While the particular physical activity of golf is a convenient example for the purposes of describing the present invention and the drawbacks of the prior art, it is to be clearly understood that discussion of the sport of golf does not limit the scope of the present invention to training devices for golf exclusively. The prior art for training devices of the type herein described is primarily concerned with the game of golf.

U.S. Pat. No. 5,005,835 to Huffman on Apr. 9, 1991, teacles a fairly rudimentary golf swing head movement monitoring apparatus. Such a device is worn on the head gear of the golfer and produces a positive feedback signal to the golfer upon proper execution of a golf swing. Such a device must be carefully adjusted to allow for the swing dynamics of each particular golfer, which complicates its use.

Another golf training device is taught in Johnson's U.S. Pat. No. 5,108,104, issued on Apr. 28, 1992. Such a device requires careful adjustment to each particular golfer's style, and assumes that a premature lifting of the golfer's head relative to striking the golf ball is physically differentiable from a properly timed lifting of the golfer's head relative to striking of the golf ball. Such a device relies solely upon a motion sensing means for input, and therefore is forced to provide feedback to the golfer based solely upon motion data. Motion data alone, however, is inadequate for determining correctness of an activity such as the lifting of one's head during or after a golf swing. The correctness of the lifting of the golfer's head is determined not in how the head is lifted, but rather in the timing relative to the striking of the golf ball. Motion data alone does not pinpoint accurately when the golf ball was struck by the club in some cases.

U.S. Pat. No. 4,560,166 to Emerson on Dec. 24, 1985, teaches a golf training device worn on the head of the golfer that includes a motion sensor and a microphone for detecting the striking of the golf ball. Essentially, if the motion sensor detects that the golfer's head is in motion when the microphone detects the striking of the golf ball, an negative feedback alarm sounds. If the motion sensor detects that the golfer's head is stationary when the microphone detects the striking of the golf ball, the alarm is inhibited.

Such a device overcomes the drawbacks of the "motion-only" prior art devices, but does have several critical drawbacks itself. Primarily, such a device takes the notification action of either sounding the alarm or not sounding the alarm immediately upon detection of trigger event, that is, the striking of the golf ball. Movement before or after the trigger event is ignored. Such movement can be just as important in the correctness of the physical activity as the movement during the trigger event. For example, in shooting a rifle, a marksman can be trained to counter the kickback force of firing the rifle so as to keep the barrel of the rifle steady between shots. A training device of this type is useless because the sound of the gun firing occurs before the motion to be detected occurs.

Further, such a training device cannot discriminate between the sound of a correctly hit golf ball and the sound of an incorrectly lit golf ball. As such, while a golfer many not have lifted his head prematurely, he may have hit the golf ball incorrectly, causing an errant shot. For example, he may have hit the top hemisphere of the golf ball instead of hitting the golf ball at its horizontal equator. In such a case, the golfer will not receive the proper feedback concerning the correctness of his swing from such a training device.

Clearly, then, there is a need for a physical activity training device which overcomes the disadvantages of known devices.

SUMMARY OF THE INVENTION

According to the invention there is provided a device that measures both motion and at least one other detectable trigger event, such as the sound of a ball being hit by a sporting implement. The present invention is, to a large extent, self-adjusting and self-calibrating, making the use of the device simple. The invented device is adaptable to a variety of physical activities and can be easily mounted on a variety of sporting gear or clothing The device is able to evaluate the correctness of motion before, during, and after the trigger event. Further, in some variations the invention is able to monitor the quality of the trigger event itself for correctness. Further, the present invention is able to download data to a separate instrument for separate analysis.

The present invention is a training device for a person performing a physical activity. The proper performance of the physical activity is related to the proper movement by the person. The invented device comprises a movement sensor, a trigger event sensor for sensing the occurrence of a specific physical trigger event, a processor, and an electronic memory. The movement sensor provides movement signal values to the processor. The processor is able to store these movement signal values in the memory. The trigger event sensor provides trigger event signal values to the processor, such trigger event signal values corresponding to the occurrence of the specific physical trigger event near the device. The processor is able to store the trigger event signal values in the memory and evaluate the trigger event signal values to determine if the specific trigger event has occurred.

A protective enclosure houses the electronic evaluation circuit and is adapted for mounting on the movable entity. A momentary electrical switch is included that, when activated, initializes an active time interval and causes the processing means to begin storing the movement signal values in the memory means. In such an embodiment, the processing means stops storing the movement signal values in tile memory means at either a first pre-defined time after the trigger event, or a second pre-defined time after the switch means has been switched.

A serial data port is included whereby a separate instrument may be used to read the movement signal values from the device. If the stored movement signal values are not within a first pre-defined range of values, the processor takes a first pre-defined notification action. Otherwise, tile processor takes a second pre-defined notification action. A notification transducer is included for signaling the notification actions of tie processor to the person, who is thereby notified of the correctness of his performance of the physical activity relative to the occurrence of the particular trigger event. The processor may also evaluate quantitatively other characteristics of the trigger event signal values to determine the correctness of the performance of the physical activity.

The invented device is relatively simple and inexpensive to manufacture, and is simple to operate and maintain. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
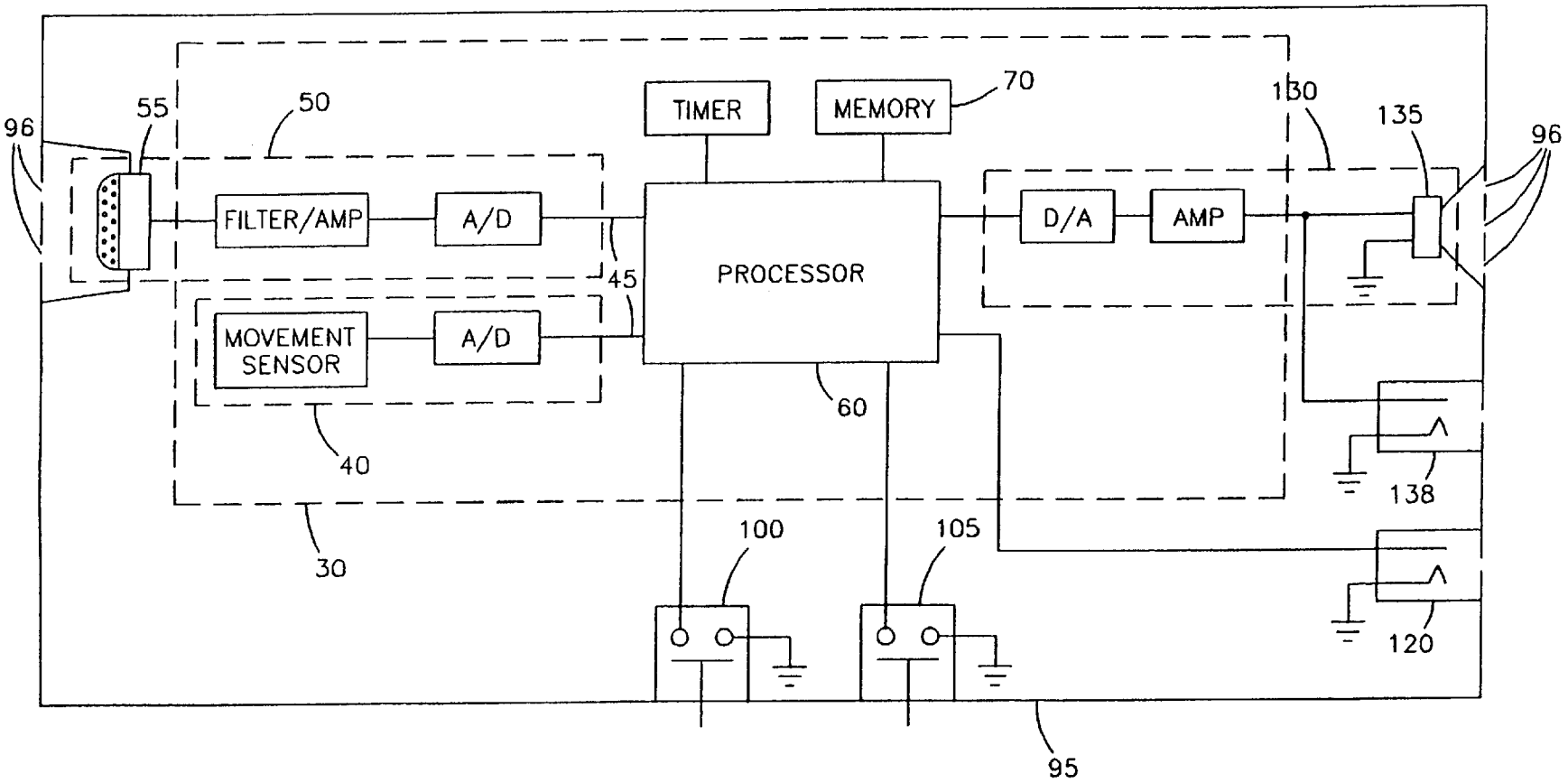
FIG. 1 is a schematic block diagram of tire primary elements of the invention.
Figure 3:
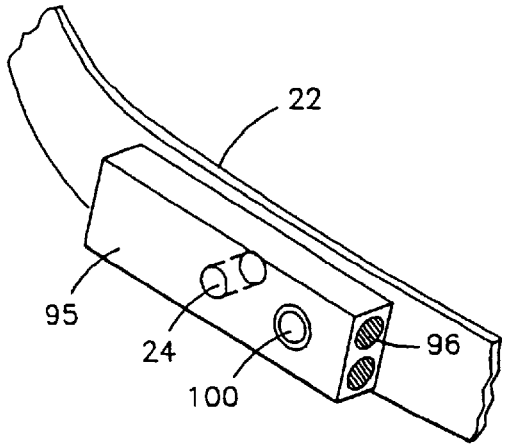
FIG. 3 is a perspective illustration of the invention of FIG. 2, illustrating in more detail the enclosure of the invention as mounted to die hat of the golfer.
Figure 2:
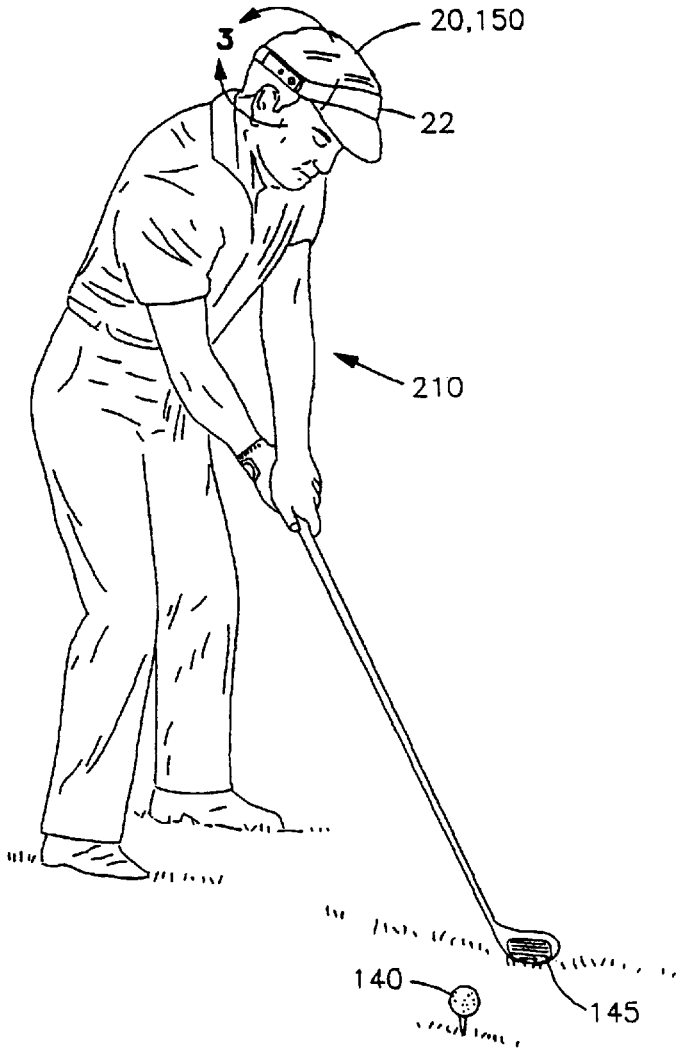
FIG. 2 is a perspective illustration of the invention as mounted in use on a fiat of a golfer.

FIGS. 1 and 2 show a training device for a person 10 performing a physical activity. The proper performance of the physical activity is related to the proper movement of a movable object or entity 20 by the person 10. For example, in the case where the physical activity is golf, the movable entity 20 may be the head 150 of the person 10, which must be moved properly in order. to properly lit a golf ball 140 with a golf club 145.

While the example of golf will be used throughout the following discussion, it is to be understood that the scope of the present invention is not to be limited thereby. It will be seen that the device of die present invention may be readily adapted to many sporting and other activities wherein the correctness of the performance of the activity is related to movement of the movable entity 20 in relation to a particular physical event width can be measured.

As best illustrated in FIG. 1, the device comprises a movement sensing means 40, a trigger event sensing means 50 for sensing the occurrence of a specific physical trigger event Eo, a processing means 60, and a memory means 70. The movement sensing means 40 provides movement signal values 80 (FIGS. 4C and 4D) to the processing means 60. Such a movement sensing means 40 may be any of many varieties commonly known to the trade for sensing motion and position, but is preferably of the type that includes a metallic cap that is electrically connected to one of several regularly spaced contacts by a movable conductive ball or other element that moves in response to motion and the influence of gravity. The processing means 60 is preferably a digital microprocessor or other comparator means, and is able to store the movement signal values 80 in the memory means 70, which is preferably a RAM or EPROM type of electronic digital memory device.

The trigger event sensing means 50 provides trigger event signal values 90 (FIGS. 4A and 4B) to the processing means 60 through a transmitting means 45, such as a signal wire. The trigger event signal values 90 correspond to the occurrence of the specific physical trigger event $E_0$ near the device. For example, in the preferred embodiment of the invention the trigger event sensing means 50 includes a microphone 55, and the particular trigger event $E_0$ causes an audible characteristic signal 110, such as the sound of the golf ball 140 being hit by the golf dub 145. The processing means 60 is able to store the trigger event signal values 90 in the memory means 60 and evaluate the trigger event signal values 90 to determine if the specific trigger event $E_0$ has occurred, namely, if the golf ball 140 has been struck by the golf dub 145. The processing means 60 is programmed to evaluate the event signal values 90 and discriminate between the trigger event $E_0$ and other audible events, such as voices, wind, aircraft engines, rattling keys, and the like. Such programming is well known, and can be readily implemented by those skilled in the art.

A protective enclosure 95 houses the electronic evaluation circuit 30, and is adapted for adjustable mounting on the movable entity 20. In the case where the physical activity is golf, for example, the enclosure 95 may be mounted on a hat 22 worn on the head 150 of the person 10 (FIG. 2). flie enclosure 95 is mounted to the hat 22 with mounting means 24, such as a frictionally tight pivot pin arrangement, or the like, so that the rotational orientation of the enclosure 95 in the vertical plane may be adjusted about the mounting means 24 for the particular style or stance of the person 10. However, one feature of the present invention is that precise adjustment of the enclosure 95 is not necessary since the processing means 60 can be programmed to re-calibrate the movement signal values 80 either upon activation of the device, or retroactively upon detection of the specific trigger event $E_0$.

Figure 4A:
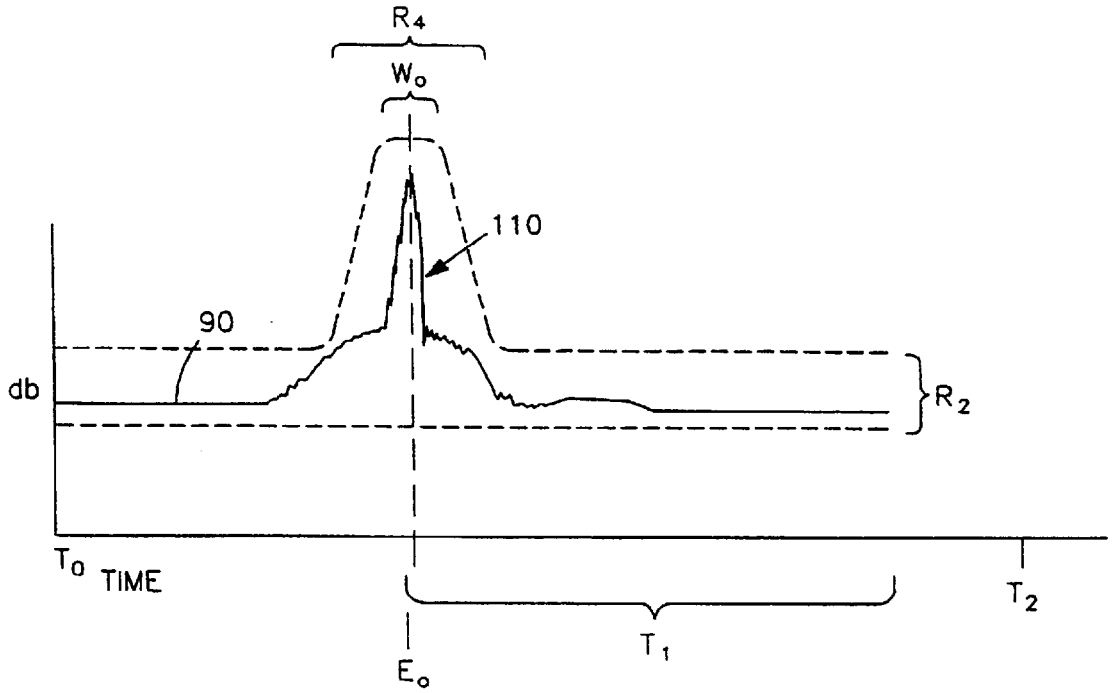
FIG. 4A is a timing diagram of the invention, illustrating trigger event signal values of a correctly executed striking of a golf bail with a golf club.

An electrical switch means 100, such as a common momentary electrical switch, is included that, when switched, initiates an active time interval beginning at $T_0$ (FIGS. 4A–4D) and causes the processing means 60 to begin storing the movement signal values 80 in the memory means 70. in such an embodiment, the processing means 60 stops storing the movement signal values 80 in tile memory means 70 at either a first pre-defined time $T_1$ after the trigger event $E_0$, or a second pre-defined time $T_2$ after the switch means has been switched (FIG. 4A). The memory means 70 has sufficient storage capacity to retain enough values 80,90 to accurately evaluate the values 80,90. The processor means 60 preferably stores all values 80,90 in a first-in first-out manner, so that only the most recent values 80,90 are retained ill the memory means 60.

Also included is a signal output means 120 such as a serial data port (FIG. 1), connected at its input to the processing means 60 whereby a separate instrument (not shown) at its output may be used to read the movement signal values 80 from the device.

In use, an interval after detection of the particular trigger event $E_0$, the processing means 60 evaluates the movement signal values 80 stored in the memory means 60 to determine if the stored movement signal values 80 are within a first pre-defined range of values $R_1$ relative to the occurrence of the trigger event $E_0$. As such, if the stored movement signal values 80 are not within the first pre-defined range of values $R_1$, the processing means 60 takes a first pre-defined notification action. If the stored movement signal values 80 are within the predefined range of values $R_1$, the processing means 60 takes a second pre-defined notification action.

A notification transducer means 130 is included for presenting the notification actions of the processing means 60. As such, the person is notified of the correctness of his performance of the physical activity relative to the occurrence of the particular trigger event $E_0$. The notification transducer means 130 may include an audio wave generator 135, as shown in FIG. 1. In such an embodiment, the enclosure 95 includes openings 96 for allowing sound waves to pass therethrough. Alternatively, the notification transducer means 130 may include a mechanically vibrating device (not shown) for providing a tactile notification to the person 10, or a light wave generator for providing a visual notification to the person 10. Transducer output means 138 may be included for private listening to the signal generated by the amplifier In order for the notification transducer means 130 not to interfere with the proper detection of either the trigger event $E_0$ or the movement signal values 80, the notification actions are delayed until a predefined time after the trigger event $E_0$ is detected.

Clearly either of the first or second notification actions may be defined as "do nothing," whereby the person 10 is only notified upon the correct performance of the physical activity alone, or the incorrect performance of the physical activity alone. Alternatively, the first notification action may be to activate the audio wave generator 135 at a frequency or series of frequencies that indicates an incorrect performance of the activity, while the second notification action may be to activate the audio wave generator 135 at a frequency or series of frequencies that indicates that the activity was performed correctly.

Figure 4B:
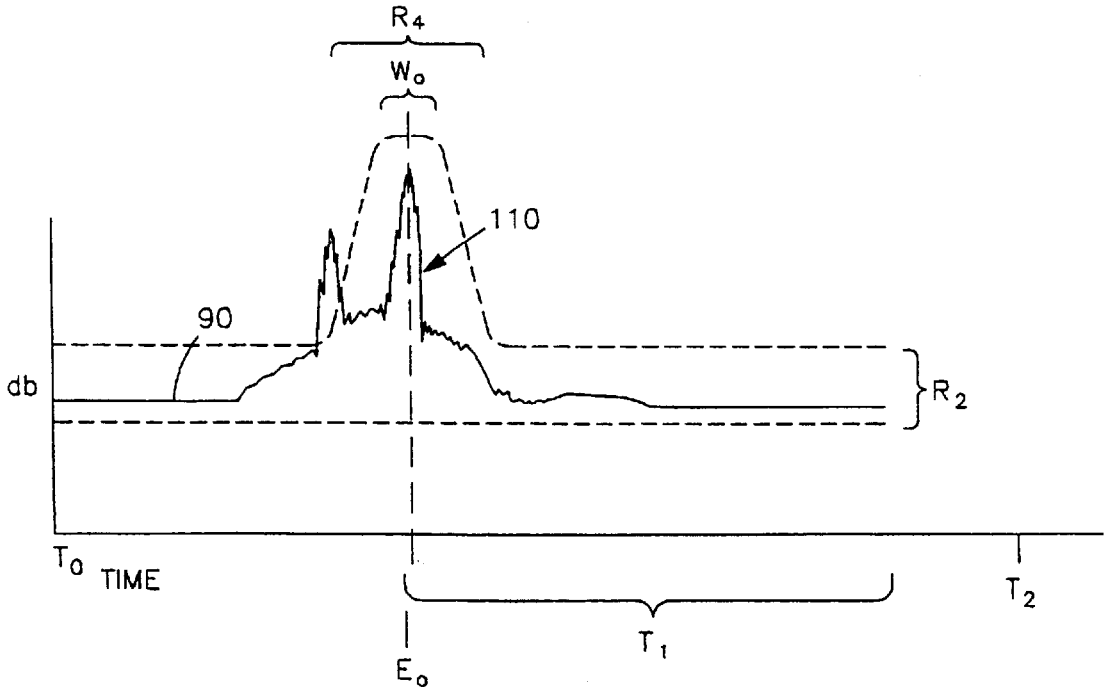
FIG. 4B is a timing diagram of tie invention, illustrating trigger event signal values of an incorrectly executed striking of the golf ball with the golf club.
Figure 4C:
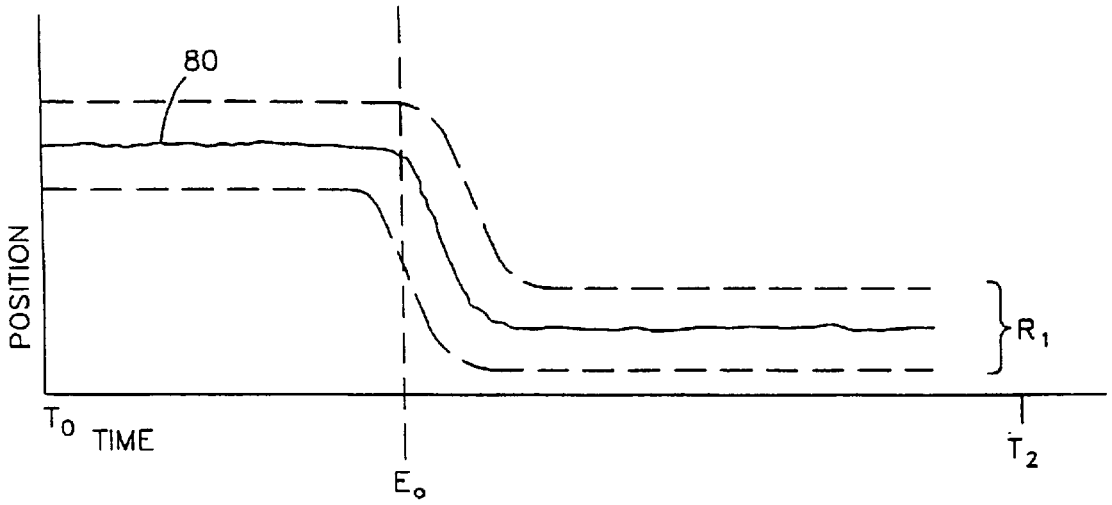
FIG. 4C is a timing diagram of the invention, illustrating movement signal values of the invention as mounted to the head of a golfer who has properly moved his head during the execution of a golf swing.
Figure 4D:
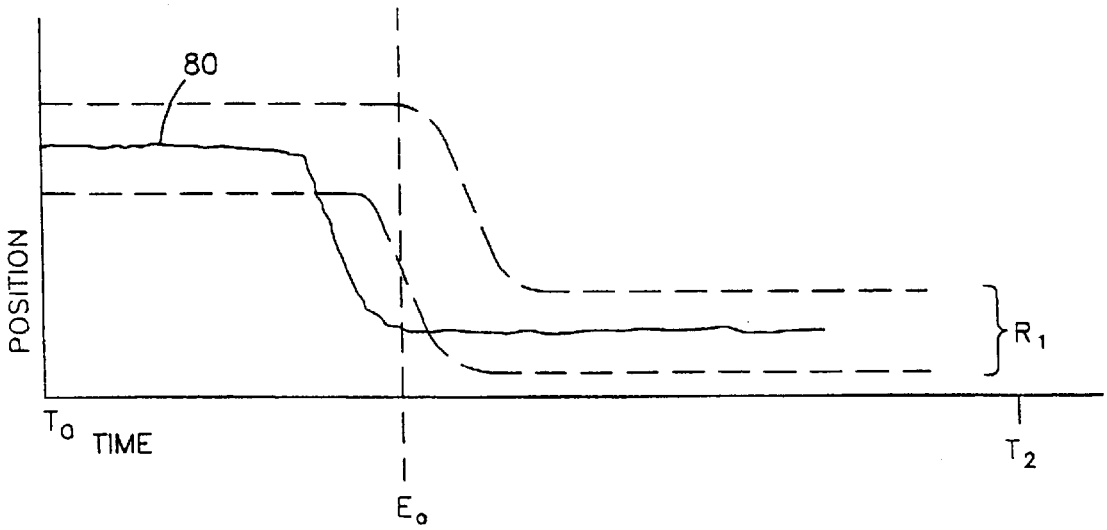
FIG. 4D is a timing diagram of the invention, illustrating movement signal values of the invention as mounted to the head of a golfer who has improperly moved his head during the execution of the golf swing.

In another embodiment of the invention, the processing means 60 further evaluates the trigger event signal values 80 stored in the memory means 60 to determine if the stored trigger event signal values 80 are qualitatively within a second pre-defined range of amplitude values $R_2$. As such, if the stored trigger event signal values 80 are not qualitatively within the second pre-defined range of values $R_2$, the processing means takes a third pre-defined notification action. Alternatively, if the stored trigger event signal values 80 are qualitatively within the second pre-defined range of values $R_2$, the processing means takes a fourth pre-defined notification action. As such, the person 10 is notified of the correctness of his performance of the physical activity based upon the trigger event signal values 80 (FIGS. 4A and 4B). Again, as with the first or second notification actions, the third or fourth notification actions may be defined as "do nothing." As such, the person 10 is only notified upon the correct performance of the physical activity alone, or the incorrect performance of the physical activity alone. Further, the third notification action may be similar to or identical with the first notification action, while the fourth notification action may be similar to or identical with the second notification action.

Similarly, as with the amplitude values of the characteristic signal 110, the processing means 60 may also quantitatively evaluate the frequency of the characteristic signal 110 to determine if the frequency of the trigger event signal values at $E_0$ is within a third pre-defined range of frequency values $R_3$. The processing means 60 may also quantitatively evaluate the pulse width $W_0$ of the characteristic signal 110 to determine if the pulse width $W_0$ of the trigger event signal values at $E_0$ is within a fourth pre-defined range of values $R_4$. Clearly other characteristics of the characteristic signal 110 may be readily evaluated by the processing means 60 to determine tie correctness of tie performance of the physical activity, such other characteristics including the slope, the number of peaks or valleys, the change in frequency, the change in slope, and so forth, of the characteristic signal 110.

As an example of this alternate embodiment, in the game of golf the sound of the golf ball 140 being correctly hit by the golf club 145 produces a quantitatively characteristic signal 110 that is different hi many of the aforementioned characteristics than is the quantitatively characteristic signal 110 of the golf ball 140 being incorrectly put by the golf club 145. As such, the processing means 60 may be programmed to quantitatively evaluate the trigger event signal values 90 to determine the correctness of the quantitatively characteristic signal 110 produced thereby. Indeed, it has even been found that the quantitatively characteristic signal 110 produced by a professional golfer correctly hitting the golf ball 140 is considerably different than that produced by an amateur golfer correctly hitting the golf ball 140.

Likewise, in the game of baseball, a baseball (not shown) makes a quantitatively characteristic signal 110 when it is lit correctly by a baseball bat. An incorrectly hit baseball creates a different characteristic signal 110, in such characteristics as pulse width, frequency, and amplitude, which can be differentiated by the processing means 60 and signaled to the batter. Clearly many sporting and other activities may be evaluated by the processing means 60 of the present invention, given proper programming thereof by anyone skilled in the art.

An amateur versus professional switch may be included (not shown) for differentiating between amateur and professional users of the device, since the characteristic signal 110 produced by each is substantially different. Preferably, however, a static RAM means is included with the memory means so that the device can maintain an ever-growing record of all of the hits of the golfer. As such, the device can compare the most recent hit of the golf ball with any of the previous hits, and calculate and present a performance rating of the most recent golf swing relative to the golfer's history of golf swings. Such an embodiment of the invention has considerable advantages over the prior art in that it can indicate the progress of the golfer's swing over relatively long periods of time.

While the invention has been described with reference to a preferred embodiment, it is to be understood by those skilled in the art that the invention is not limited thereto. Rather, the scope of the invention is to be interpreted only in conjunction within the appended claims.

What is claimed is:

1. A training device for a person performing a physical activity in which the person directly or indirectly interacts with an object to produce a trigger event, said training device including:

a sensor device which detects the trigger event and any movement of the person and provides data corresponding to such movement, and a data processor, including a memory that records said data over a period of time including the occurrence of the trigger event, said data processor processing the data and presenting the results of the processed data to the person.

2. The training device of claim 1 where the period of time begins at least at the occurrence of the trigger event.

3. The training device of claim 1 where the period of time ends either shortly after the trigger event or after the occurrence of a predetermined amount of time.

4. The training device of claim 1 where the movement of the person is sensed during the trigger event and either before or after the trigger event.

5. The training device of claim 1 where the movement of the person is sensed before the trigger event, during the trigger event, and after the trigger event.

6. The training device of claim 1 where the data processor notifies the person if the movement data relative to the trigger event is within or not within certain values.

7. The training device of claim 6 where the data processor notifies the person after the detection of the trigger event.

8. The training device of claim 1 including a comparator which compares a measure of the trigger event to a measure of the movement data and notifies the person if the movement data is within or not within a certain value.

9. The training device of claim 1 where the notification comprises a visual, audible or tactile indicator.

10. The training device of claim 1 where the data is stored in the memory in a first-in-first-out manner.

11. The training device of claim 1 where the sensor system upon detecting the trigger event provides a signal which is characteristic of the trigger event and the data processor is programmed to evaluate said trigger event signal.

12. The training device of claim 1 including a skill selection control which adjusts processing the data according to skill levels.

13. A training device for a person performing a physical activity in which the person directly or indirectly interacts with an object to produce a trigger event, said training device including:

a first sensor which detects the trigger event, a second sensor which senses movement of the person and provides data corresponding to such movement of the person, and a data processor, including a memory that records said data over a period of time including the occurrence of the trigger event, said data processor processing the data and presenting the results of the processed data to the person.

14. The training device of claim 13 where the period of time begins at least at the occurrence of the trigger event, the data processor notifies the person after the detection of the trigger event and if the movement data relative to the trigger event is within or not within certain values.

15. The training device of claim 13 including a comparator which compares a measure of the trigger event to a measure of the movement data and notifies the person if the movement data is within or not within a certain value.

16. The training device of claim 13 where the notification comprises a visual, audible or tactile indicator.

17. The training device of claim 13 where the first sensor upon detecting the trigger event provides a signal which is characteristic of the trigger event and the data processor is programmed to evaluate said trigger event signal.

18. The training device of claim 13 including a skill selection control which adjusts processing the data according to skill levels.

19. A training device for a person performing a physical activity in which the person directly or indirectly interacts with an object to produce a trigger event, said training device including:

a sensor device which detects the trigger event and any movement of the person and provides data corresponding to such movement, said sensor device upon detecting the trigger event providing a signal which is characteristic of the trigger event, and a data processor, including a memory that records said data over a period of time including the occurrence of the trigger event, said data processor being programmed (a) to measure said trigger event signal, (b) to compare said measure of the trigger event signal to a measure of the movement data, and (c) to notify the person if the movement data is within or not within a certain value.

20. A method for training a person performing a physical activity in which the person directly or indirectly interacts with an object to produce a trigger event, said method including:

sensing the trigger event and any movement of the person and providing data corresponding to such movement, and processing the data processor, including recording in memory said data over a period of time including the occurrence of the trigger event, and presenting the results of the processed data to the person.

* * * * *